US005642548A

United States Patent [19]

Osbourn

[11] Patent Number: 5,642,548

[45] Date of Patent: Jul. 1, 1997

[54] APPARATUS AND METHOD FOR WET PROCESSING TRAVELING TEXTILE MATERIAL

[75] Inventor: Charles Anthony Osbourn, Fort Oglethorpe, Ga.

[73] Assignee: Gaston County Dyeing Machine Company, Stanley, N.C.

[21] Appl. No.: 603,725

[22] Filed: Feb. 20, 1996

[51] Int. Cl.[6] ..... D06B 3/28

[52] U.S. Cl. ..... 8/152; 68/27; 68/178

[58] Field of Search ..... 8/151, 152; 68/22 R, 68/27, 175, 176, 177, 178

[56] References Cited

U.S. PATENT DOCUMENTS

| | | | |
|---|---|---|---|
| 3,848,438 | 11/1974 | Tachibana et al. | 68/22 R |
| 3,875,769 | 4/1975 | Inoue | 68/27 X |
| 3,977,220 | 8/1976 | Clark et al. | 68/22 R |
| 4,107,801 | 8/1978 | Tachibana | 68/22 R X |
| 4,440,003 | 4/1984 | Koch | 68/22 R |
| 4,633,806 | 1/1987 | Schuierer | 68/27 X |
| 5,469,720 | 11/1995 | Paggi | 68/178 X |

*Primary Examiner*—Philip R. Coe

*Attorney, Agent, or Firm*—Shefte, Pinckney & Sawyer

[57] ABSTRACT

In a textile wet processing machine and process wherein an indeterminate length of a textile fabric or other material is washed or otherwise subjected to a wet treatment operation by transportation sequentially through a plurality of processing chambers, the yardage distribution of the fabric among the chambers is controlled by sensing the entrance of the leading end of the fabric into each successive chamber, then measuring separately the actual yardage of fabric entering each chamber in sequence, comparing at least periodically the yardage of fabric instantaneously residing within each respective chamber and, in the event an imbalance in fabric distribution is detected, briefly stopping and then restarting lifter reel assemblies and jet nozzle assemblies by which the fabric is transported so as to correct the imbalance in fabric distribution.

18 Claims, 7 Drawing Sheets

APPARATUS AND METHOD FOR WET PROCESSING TRAVELING TEXTILE MATERIAL

BACKGROUND OF THE INVENTION

The present invention relates generally to textile machines of the type used for wet processing of a traveling length of textile material and to methods of wet processing textile materials utilizing such machines. More particularly, the present invention relates to textile wet processing machines and methods wherein an indeterminate length of textile material travels sequentially through a series of material processing chambers and to a means and methodology for controlling the relative lengths of the textile material potions within the respective chambers.

Various types and forms of machines are known and in use in the textile industry for performing diverse finishing operations by the application of a liquid treatment to the textile material, such machines and methods of operation commonly being referred to broadly as wet processing. One common type of wet processing operation to which textile fabrics particularly are subjected is a washing operation, typically performed following a preceding wet processing operation for purposes of removing and/or neutralizing excess treating liquid remaining in or on the fabric from the previous operation. For example, a washing operation is typically performed on a textile fabric subsequent to a bleaching operation in order to completely remove bleach remaining in the fabric and to neutralize the fabric.

Conventional textile washing apparatus of differing constructions are known. In one form of such apparatus, the textile material to be washed is transported in sequence through a series of liquid containment chambers, typically by means of a lifter reel and liquid jet nozzle arrangement disposed between the chambers. The chambers are essentially separate from one another so that the fabric is subjected to a progressive cleaning of bleach or other liquid treatment compositions as the fabric advances from one chamber to the next.

One of the difficulties experienced in the on-going commercial operation of such textile washing apparatus is the maintenance of essentially the same quantity of fabric in each successive chamber, which is desirable from an operational standpoint in order to ensure that the fabric is subjected to the optimal degree of washing in each chamber and also from a safety and quality control standpoint in order to prevent the extreme occurrence that one or more chambers become substantially depleted of fabric which could ultimately result in severe damage to the fabric. While theoretically the setting of the several lifter reels and liquid jet assemblies between the successive chambers to operate at constant uniform speeds should achieve a balance of essentially the same quantity of fabric in each chamber, uncontrollable operational variables which routinely occur over the course of the washing process, e.g., sporadic slippage of the fabric on the lifter reels, random tangling of the fabric at different locations from chamber to chamber, the differential action of the jetted liquid in propelling the fabric depending upon the orientation of the fabric as it passes through the liquid jet assemblies, and changes in fabric type and weight from one fabric lot to the next, still causes imbalances to occur in the amount of fabric from chamber to chamber.

Several different forms of control systems have been proposed and implemented to address the objective of maintaining a generally uniform quantity of fabric in each of the plural chambers of such washing machines. In one form of control system, a physical switch is provided in each chamber at a predetermined elevation above the bottom of the chamber to be actuated in the event an excessive quantity of fabric accumulates within the chamber and, in turn, to initiate an appropriate change in the operation of the apparatus to alleviate the excess accumulation of fabric. Disadvantageously, however, the presence of such a physical switch presents the risk of unintended contact with the fabric which can produce tangling in the fabric or even cause damage to the fabric as a result of snagging on the switch.

An alternative form of washer control system utilizes a load cell in each chamber to at least periodically measure the weight of fabric momentarily present within each chamber so that a comparison can be made and appropriate corrective action taken, if necessary. Unfortunately, however, such a load cell-based system can be subject to inaccuracies because the load cell necessarily is weighing the entire contents of the chamber, which includes both the fabric itself and the washing liquid present within the chamber. Hence, fabric imbalances may not be recognized if offsetting imbalances in the amount of liquid in each chamber also occur at the same time. Conversely, imbalances in the amount of liquid from one chamber to the next can cause the control system to incorrectly detect a non-existent imbalance in the comparative quantities of fabric.

SUMMARY OF THE INVENTION

It is accordingly an object of the present invention to provide an improved form of control system and control methodology for use in a textile wet processing apparatus and process of the type wherein a textile material is sequentially transported through a series of liquid processing chambers thereby making necessary or desirable the maintenance of predetermined relative quantities of the fabric among the sequence of processing chambers.

Basically, the apparatus and method of the present invention is adapted to substantially any wet processing operation wherein an indeterminate length of a traveling textile material, especially textile fabric, is transported sequentially through a plurality of material processing chambers, such as in a multi-chamber textile fabric washing apparatus and method. Typically, it will be preferred that the material be transported through the chambers by a corresponding series of lifter reels and liquid jet assemblies arranged between the chambers to convey the material from one chamber to the next, but it is contemplated that other forms of material transport means could be utilized.

Briefly summarized, the present invention provides a novel control system and methodology wherein the entrance of a leading end of the textile material into each respective chamber is detected by appropriate means, e.g., a fiber optic sensor or other suitable means for optically recognizing the leading end of the material, and the length of the material thereafter entering each respective chamber is measured by a suitable means, such as by providing a roller peripherally contacting the traveling material entering the chamber and by counting the revolutions of the roller as an indication of the fabric length. From the on-going measurement of the lengthwise dimension of the fabric entering each respective chamber, the length of the material momentarily present in each respective chamber can be computed, either continuously or at least periodically, the respective computed lengths of material for the respective chambers can be compared with one another, and appropriate adjustments in the transport of the material through the chambers can be controlled in order to maintain predetermined relative lengths of the material within the respective chambers. By way of example, a suitable controller or other form of data processing means, e.g., a programmable logic controller, can be connected to the detector and measuring device associated with each chamber and with the material transporting arrangement for such purposes.

In the preferred embodiment of the present wet processing apparatus and method, the lifter reels and liquid jet assemblies (or such other material transport arrangement as is provided) are controlled in accordance with a predetermined program, e.g., stored in the controller, to maintain essentially the same relative lengths of the material within the respective chambers within a defined tolerance range, preferably by stopping and restarting operation of the reel and the liquid jet arrangement associated with any one of the chambers as necessary to decrease the length of material therein and increase the length of material in the preceding chamber. The chambers are substantially distinct from one another so that each chamber contains a separate quantity of processing liquid, but liquid overflow weirs may be provided between the chambers at differing heights to cause the processing liquid to overflow from one chamber sequentially to the next preceding chamber opposite the direction of material travel through the chambers.

DETAILED DESCRIPTION OF THE PREFERRED EMBODIMENT

Figure 1:
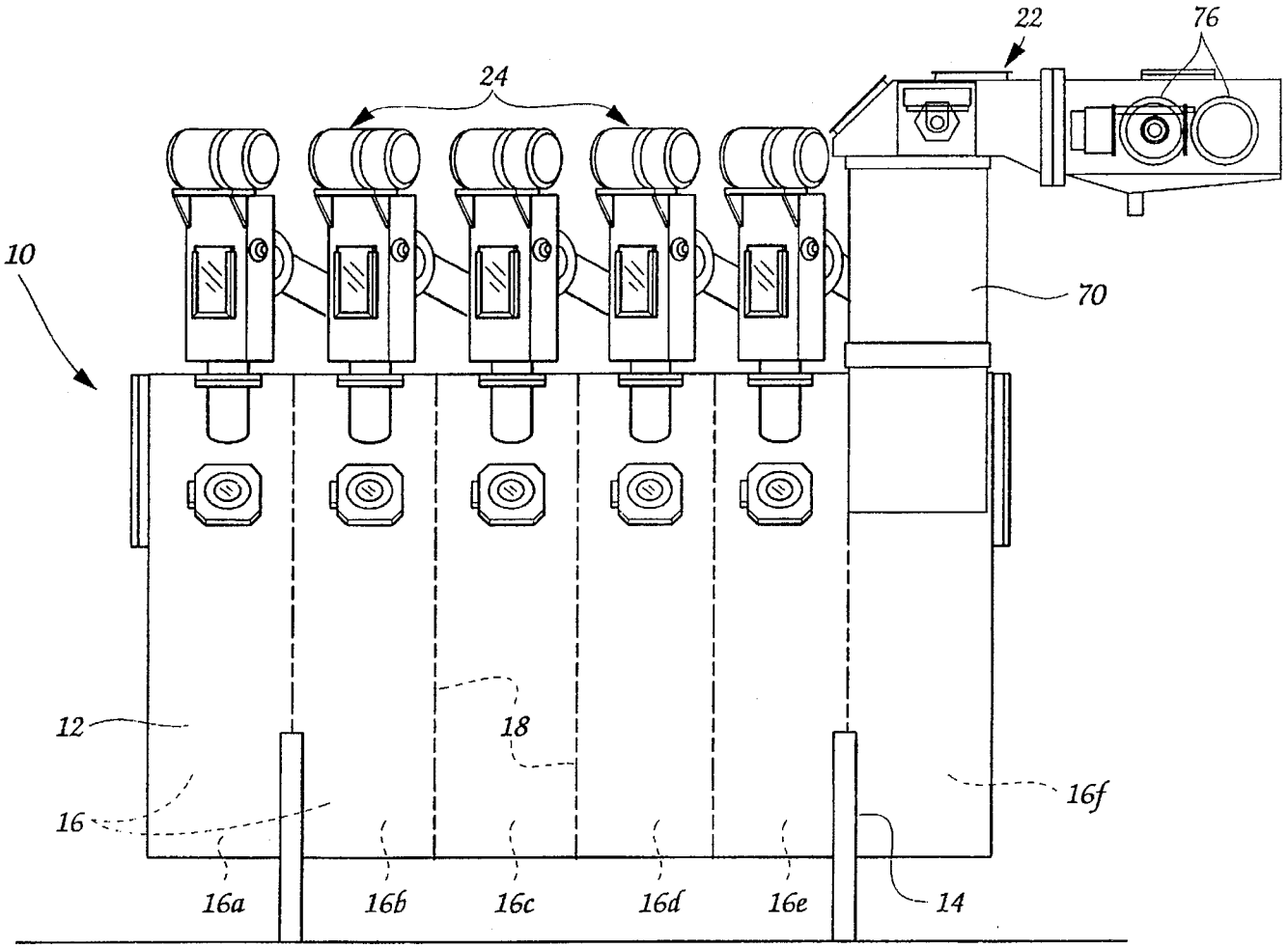
FIG. 1 is a front elevational view of a wet processing apparatus particularly intended for washing of textile fabric, in accordance with the preferred embodiment of the present invention.
Figure 2:
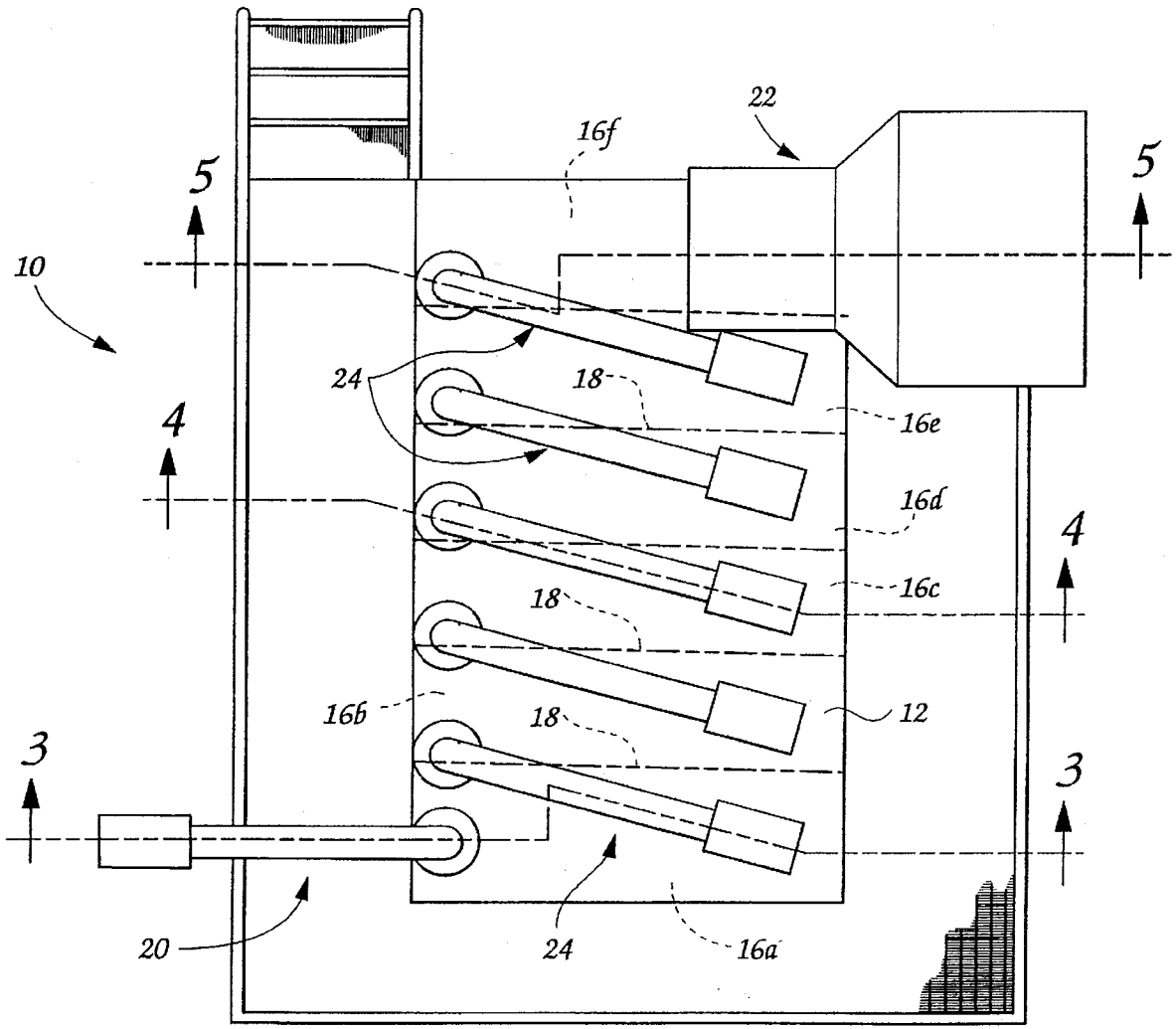
FIG. 2 is a partially schematic top plan view of the wet processing apparatus of FIG. 1.

Referring now to the accompanying drawings and initially to FIGS. 1 and 2, the present invention is illustrated as preferably embodied in a multi-chamber textile wet processing machine of the jet type commonly employed for the continuous washing of a traveling indeterminate length of textile fabric, generally indicated at 10. As those persons skilled in the art will recognize and understand, varying forms of such textile wet processing machines are known in the textile industry. Further, it is contemplated that the present invention may be readily adapted to and incorporated in many such machines, as well as in virtually any other wet processing machine wherein a textile material travels in lengthwise form sequentially through a series of processing chambers. Accordingly, the machine 10 is herein illustrated and described only schematically to the extent necessary to facilitate an understanding of the present invention and to be representative of the application of the present invention to any suitable form of multi-chamber wet processing machine.

Basically, the machine 10 includes a closed vessel 12, typically of cylindrical form disposed with a generally horizontally extending axis and mounted on a floor-supported base 14. The axial extent of the cylindrical vessel 12 is sufficient to accommodate internally a plurality of U-shaped treating chambers 16 arranged side by side along the axial length of the machine and separated from one another by upright dividing walls 18 arranged in spaced parallel relation along the interior of the vessel 12. In the illustrated embodiment, the machine 10 is equipped with six such processing chambers 16, designated as 16A, 16B, 16C, 16D, 16E, 16F, although it will be understood that a greater or lesser number of such chambers can be utilized as necessary or desirable for a particular wet processing application.

As already indicated, the machine 10 is operative, as more fully described below, to continuously transport textile fabric in lengthwise fashion, typically in rope form, through the processing chambers 16 in sequence. For this purpose, a fabric delivery structure 20 is connected to the machine 10 at one axial end of the vessel to deliver the fabric, designed representatively at F, into the first chamber 16A, a fabric discharge structure 22 is similarly connected to the machine 10 at the opposite axial end of the vessel 12 to withdraw the traveling fabric F from the last chamber 16F, and a series of five identical superstructures 24 are mounted to the top of the vessel 12 intermediate the six chambers 16 to progressively withdraw the fabric F from one chamber 16 and transfer the fabric F to the next chamber 16 in series, so as to transport the fabric F progressively through the chambers 16 in lengthwise sequence from the fabric delivery structure 20 to the fabric discharge structure 22.

Figure 3:
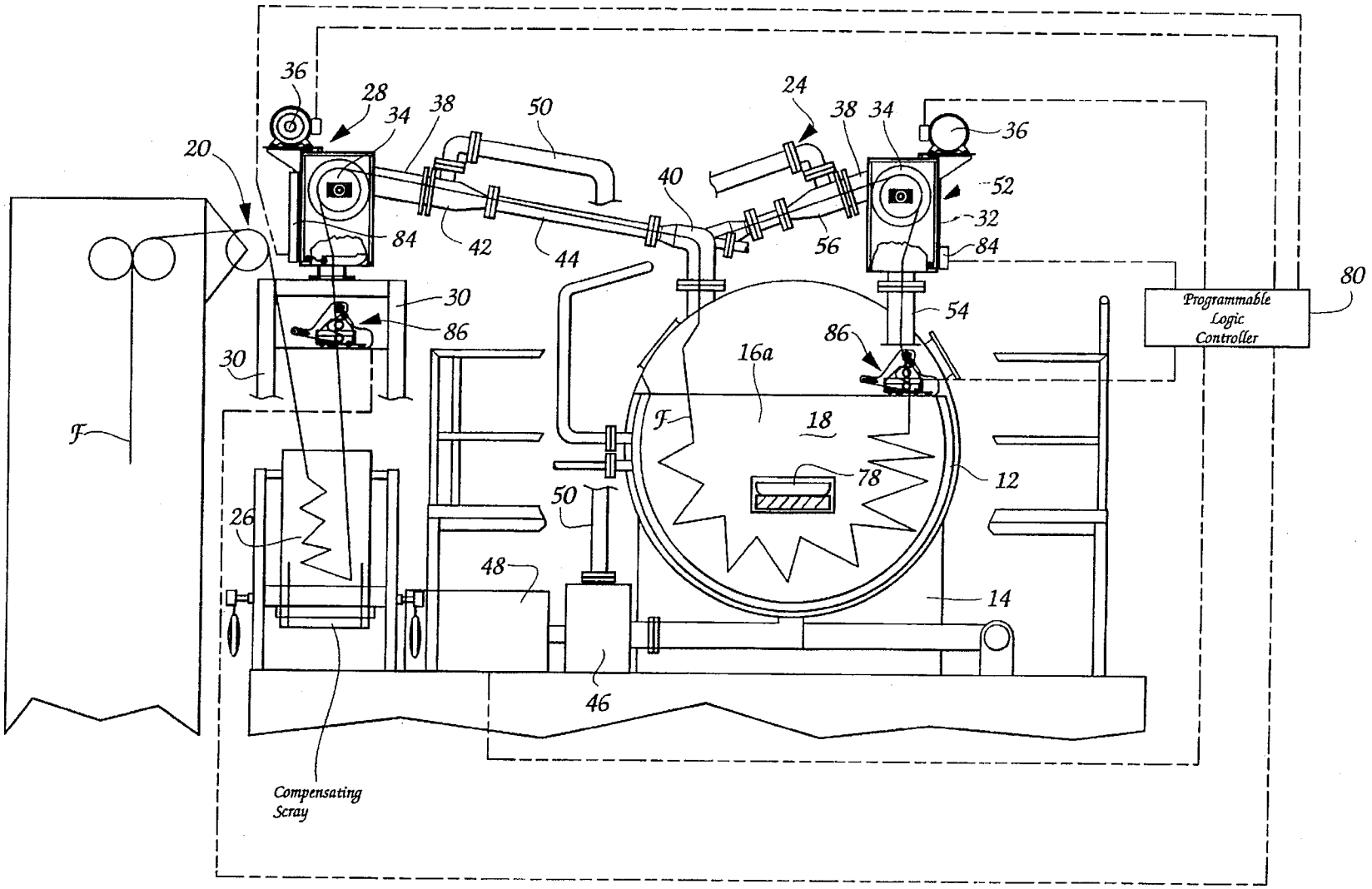
FIG. 3 is a schematic diagram depicting the wet processing apparatus of FIGS. 1 and 2 in vertical cross-section taken along line 3—3 of FIG. 2.

In a typical application, the wet processing machine 10 will be situated to receive fabric discharged from a fabric bleaching range (not shown), in order to wash the fabric sufficiently to remove and neutralize the bleaching composition still carried by the fabric F. For this purpose, the fabric delivery structure 20 comprises a scray 26, sometimes referred to as a J-box, into which the incoming fabric F from the bleach range is deposited and accumulated in a pleated form while awaiting conveyance into the wet processing machine 10. A lifter reel assembly 28 is supported on upstanding stanchions 30 directly above the scray 26 to progressively withdraw the accumulated fabric F therefrom, the lifter reel assembly 28 basically comprising a housing 32 in which a reel 34 is supported and driven by an electric drive motor 36. A tubular flanged fabric discharge conduit 38 opens into and extends from the housing 32 adjacent the lifter reel 34 toward a flanged fabric inlet elbow 40 extending upwardly from the vessel 12 above the first treatment chamber 16A, the conduit 38 and the elbow 40 being connected to one another by a tubular jet nozzle assembly 42 and a downstream length of connecting pipe 44. The jet nozzle assembly 42 may be of substantially any conventional construction adapted for passage of the fabric F axially through the center of the nozzle assembly 42 and operative to impinge the fabric F with a pressurized annular stream of a processing liquid so as to further impart traveling movement to the fabric F into and through the connecting pipe 44. As seen in FIG. 3, a liquid pump 46 driven by an associated electric motor 48 is connected to the bottom of the vessel 12 beneath the first chamber 16A to progressively withdraw processing liquid from the chamber and deliver the liquid under pressure through a connecting pipe 50 to supply liquid to the jet nozzle assembly 42. In this manner, the overall operation of the fabric delivery structure 20 is to progressively lift the accumulated fabric F from the scray 26 and deliver the fabric into the jet nozzle assembly 42 which, in turn, entrains the fabric F in a continuous moving stream of pressurized processing liquid to transport the fabric F into the adjacent entrance side of the first processing chamber 16A within which the fabric F accumulates in a plaited form to progress gradually through the chamber following its U shape, while being at least partially submerged within the quantity of processing liquid contained within the chamber.

Figure 4:
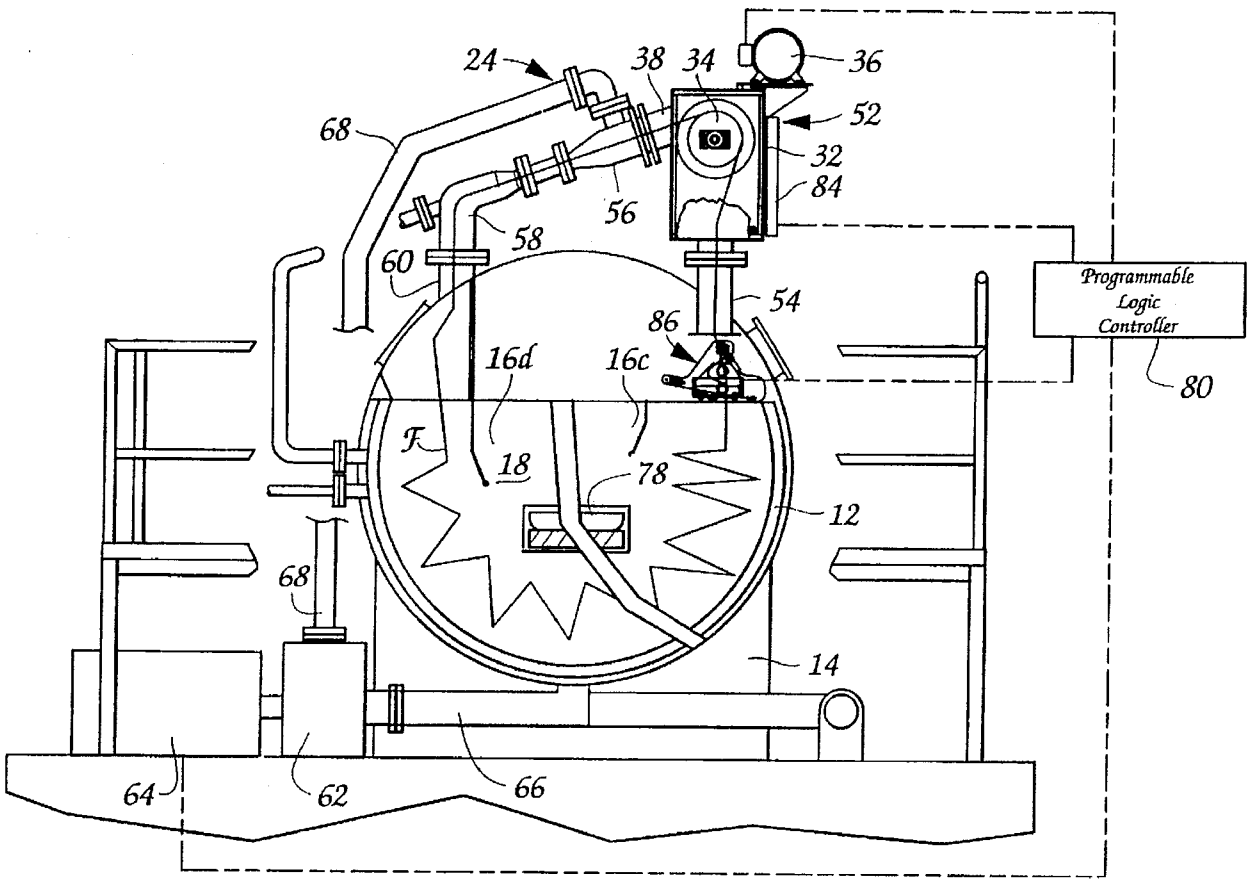
FIG. 4 is a schematic diagram depicting the wet processing apparatus of FIGS. 1 and 2 in vertical cross-section taken along line 4—4 of FIG. 2.

Each of the five superstructures 24 is of substantially identical construction to one another and can best be seen and understood with reference to FIGS. 3 and 4. Each superstructure 24 comprises a lifter reel assembly 52 substantially identical in construction to the lifter reel assembly 28, mounted by means of a vertical fabric intake pipe 54 directly above a respective corresponding one of the first five processing chambers 16A–16F at the side of the vessel 12 opposite the fabric delivery structure 20, thereby to receive and withdraw upwardly the fabric F from an exit side of the corresponding chamber 16. Thus, each lifter reel assembly 52 has a housing 32 in which a reel 34 is drivenly rotated by a motor 36, with a tubular fabric discharge conduit 38 extending laterally from the housing 32 adjacent the reel 34. Each superstructure 24 additionally includes a jet nozzle assembly 56, substantially identical in construction to the jet nozzle assembly 42, connected at an entrance end to the conduit 38 and at an exit end to an elbow pipe 58 (FIG. 4) mounted to an upwardly projecting flanged fitting 60 at the top of the vessel 12 directly above the entrance side of the next successive chamber 16. The jet nozzle assembly 56 is continuously supplied with pressurized treating liquid withdrawn by a respective pump 62 from the next succeeding chamber 16 into which the jet nozzle assembly 56 discharges through a withdrawal pipe 66 connected to the intake side of the pump 62 and delivered to the jet nozzle assembly 56 by a connecting pipe 68 extending from the discharge side of the pump 62 and opening into the jet nozzle assembly 56.

In this manner, each superstructure 24 operates through its lifter reel assembly 52 to elevate the fabric F lengthwise from the exit end of one chamber 16A–16E and to deliver the fabric into the associated jet nozzle assembly 56 to be impinged and entrained within the jetted liquid to convey the fabric F into the entrance side of the next succeeding chamber 16B–16F. As will be understood, the fabric F is deposited into plaited form at the entrance side of each successive chamber 16 and progresses through the U-shaped chamber to the exit side to be removed by the next lifter reel assembly 52, in substantially the same manner as described above with regard to the first chamber 16A.

Figure 5:
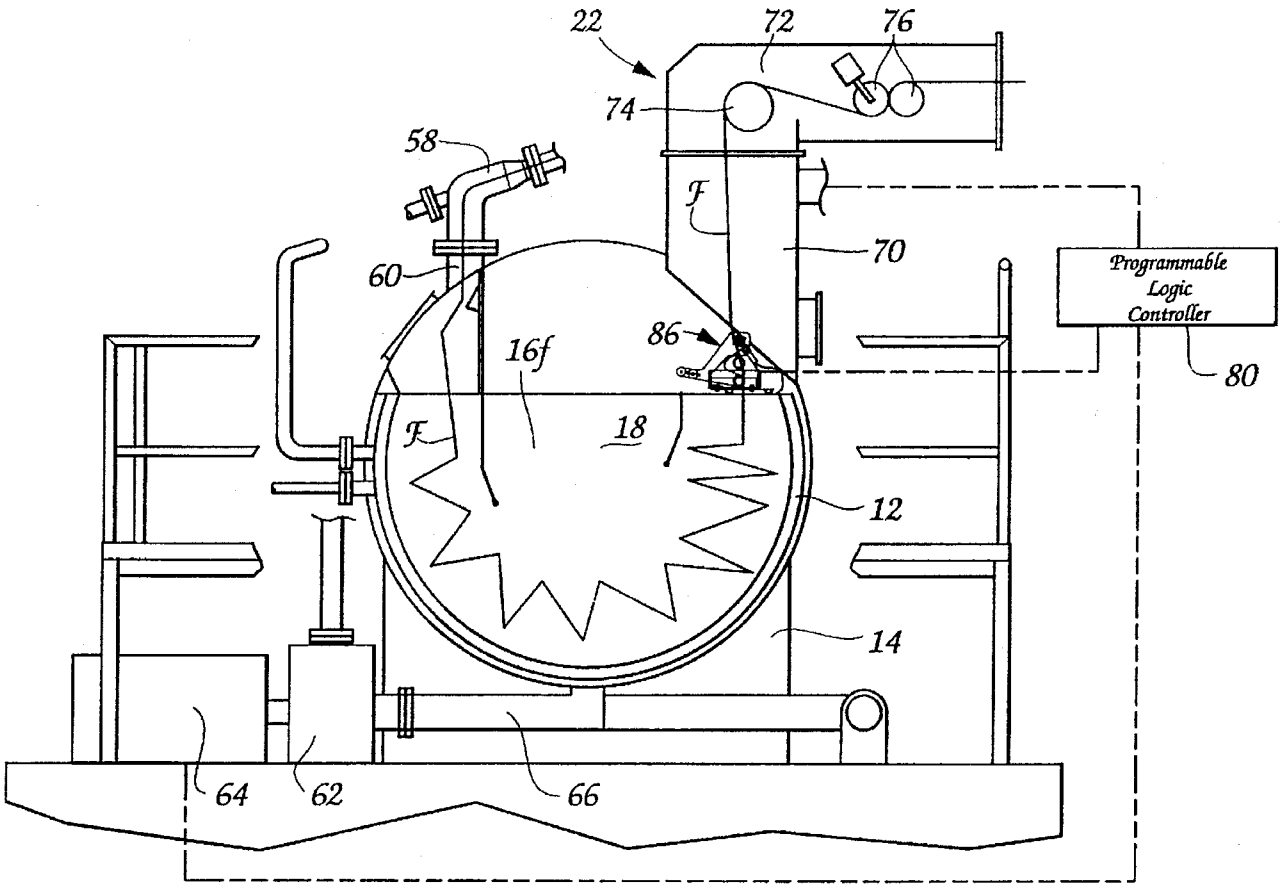
FIG. 5 is a schematic diagram depicting the wet processing apparatus of FIGS. 1 and 2 in vertical cross-section taken along line 5—5 of FIG. 2.

As best seen in FIG. 5, the fabric discharge structure 22 basically comprises a vertical discharge housing 70 affixed to the top of the vessel 12 to extend upwardly from directly above the discharge side of the last chamber 16F in series, and a horizontal discharge conduit 72 mounted perpendicularly to the upper end of the discharge housing 70 to transport the washed fabric F to a downstream take-up or storage location or to a next succeeding processing operation. A driven lifter reel 74 is rotatably supported within the horizontal discharge conduit 72 directly above the upper end of the discharge housing 70 and serves to direct the exiting fabric F in S-wrap fashion about a pair of pinch rollers 76.

Since the preferred intended application of the embodiment of the present apparatus depicted in the accompanying drawings is for washing a bleach composition from fabric received from a preceding bleach range, the preferred "treating liquid" referenced above will typically be water for the majority of the processing chambers 16, which will be understood to be effective to substantially remove the bleach composition from the fabric F by a leaching action and to essentially completely dilute any remaining bleach held in the interstices of the fabric. Heated water is preferably utilized as the treating liquid of choice in the first four chambers 16A–16D in sequence. A neutralizing composition, e.g., in the form of a water-based solution containing carbon dioxide or acetic acid, is preferably utilized in the fifth chamber 16E for purposes of neutralizing any remaining bleach held in the fabric. The final chamber 16F is preferably supplied with clean fresh unheated water to wash the neutralizing composition from the fabric. Of course, those persons skilled in the art will recognize and understand that the selected chambers and the number of chambers to which such processing liquids are supplied can be varied as necessary or desirable according to a specific washing operation and, alternatively, other forms of washing compositions may be substituted in appropriate circumstances.

While it is considered desirable to maintain the respective quantities of processing liquids in the several chambers substantially separate from one another, it is considered desirable in the particular embodiment herein described to provide for a partial overflow of the heated water among the first four chamber 16A–16D to progressively overflow in reverse from the chamber 16D to the chamber 16A. This countercurrent overflow of the heated water is accomplished by providing a weir opening 78 in each of the three dividing walls separating the first four chambers 16A–16D, with the weir openings 78 being of progressively higher elevation from chamber 16A to chamber 16D. In this manner, any fibers, lint, and other debris released from the fabric by the action of the washing liquid will tend to float to the upper surface of the liquid within the fourth chamber 16D and overflow with the excess heated water therefrom into the chamber 16C, then into the chamber 16B and finally into the chamber 16A from which such floating debris will escape over another weir (not shown) for collection and disposal.

As mentioned above, the apparatus and method of the present invention provides a novel system for controlling the yardage of fabric momentarily present within each of the sequential chambers 16A–16F essentially throughout an on-going washing operation so as to ensure that substantially the same length of the fabric F is maintained in each chamber (or alternatively to maintain any other predetermined relationship between the length of the fabric F within each respective chamber). For this purpose, appropriate means are provided at the entrance to each chamber 16A–16F to ensure that the leading end of the fabric F is recognized as it first enters each chamber in sequence and an associated measuring device for determining the passing yardage of the traveling fabric is then actuated for each chamber in sequence, all under a common control means, preferably a programmable logic controller indicated only schematically at 80 in FIGS. 3–5.

Figure 7:
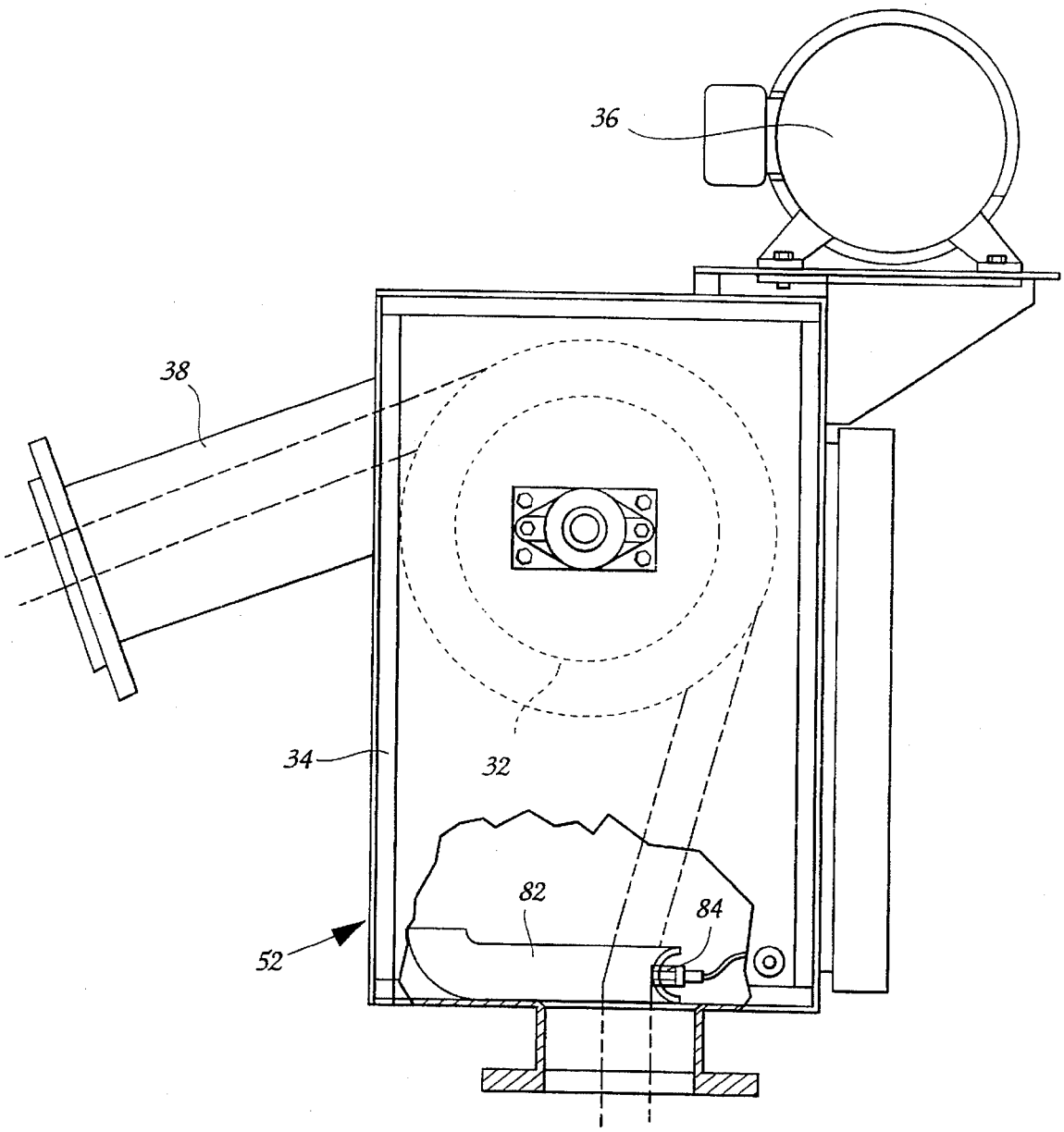
FIG. 7 is an enlarged view of the lifter reel assembly associated with one of the chambers of the apparatus, shown partially in end elevation and partially in broken-away vertical cross-section to show the optical sensor thereof.

As will be understood, the washing operation of the apparatus 10 progresses on a continuous basis, with differing lengths of fabric representing differing fabric production lots being connected end to end and transported in sequence through the apparatus to ensure uninterrupted operation. According to the present invention, a short segment of a substantially black piece of connecting fabric is sewn between the trailing end of one fabric length and the leading end of the next following fabric length in the on-going washing process so as to provide an optically recognizable indicator of the leading end of each new length of fabric being processed. In turn, each lifter reel assembly 28,56,74 is equipped with a poteye 82 (see FIG. 7) through which the fabric F passes immediately prior to reaching each lifter reel and each such poteye 82 is fitted with a fiber optic sensor, each indicated only representatively by a schematic block 84 in FIGS. 3–5 with a representative illustration of the sensor 84 for one such poteye 82 being shown in FIG. 7, to be capable of optically detecting the passage of each black fabric leader section. Each such fiber optic sensor 84 is individually connected to an appropriate input to the PLC 80 for transmitting a signal thereto indicating passage of the black fabric leader section.

Figure 6:
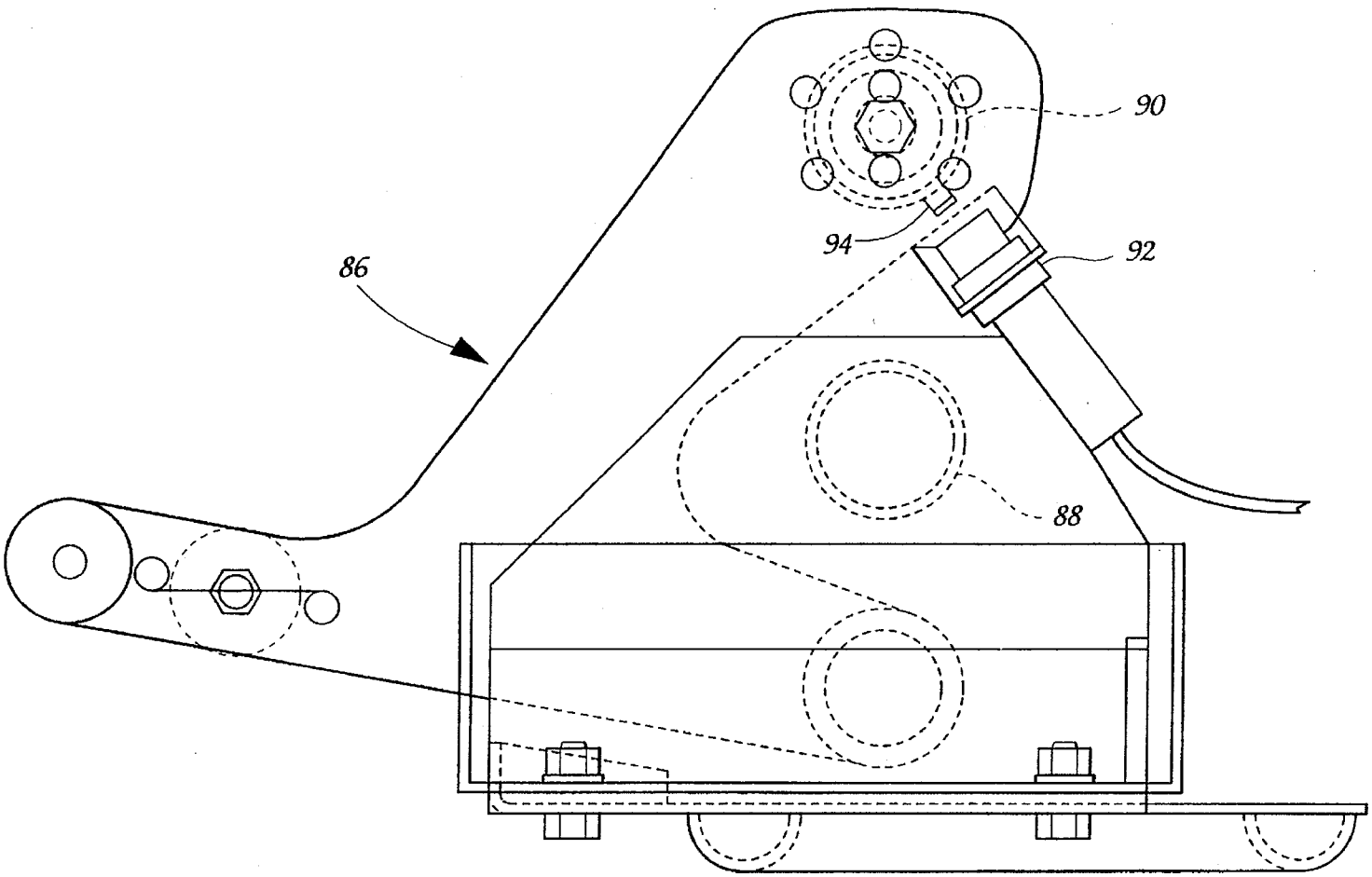
FIG. 6 is an enlarged elevational view of the counter assembly associated with one of the chambers for measuring the fabric length passing therethrough.

As will also be seen in FIGS. 3–5, a yardage measuring device 86 is disposed a short distance in advance of each fiber optic sensor 84. As best seen in FIG. 6, each such measuring device 86 basically comprises a pair of parallel spaced rollers 88,90 about which the fabric F is trained to travel in an S-wrap fashion, with a proximity sensor switch 92 being aimed at the periphery of the downstream roller 90 to recognize each revolution of the roller 90 by the passage of a compatible sensor knob 94 affixed to the periphery of the roller 90. Each such proximity sensor switch 92 is independently connected to a respective input to the PLC 80 to transmit a series of signals to the PLC 80 representing the progressive revolutions of the roller 90 by the force of driving contact with the traveling fabric F. In this manner, the PLC 80 is enabled to determine the actual yardage of the fabric F passing each roller 90 by simple multiplication of the number of signaled revolutions of the roller 90 with the known circumference of the roller 90.

As also represented in FIGS. 3–5, respective outputs of the PLC 80 are independently connected to the drive motors 36 to each lifter reel 34 and also to each pump motor 48,64. In this manner, the PLC 80 is enabled through appropriate programming to selectively control the actuation and deactuation, or to otherwise adjustably vary the operation of, each lifter reel 34 and each jet nozzle assembly 42,56, as will be presently described.

As is known, various forms of programmable logic controllers are widely available from a number of manufacturers, any of which should be suitable for use in the present invention provided a sufficient number of independent inputs and outputs are provided for connection to the various optical sensors 84, proximity sensor switches 92, lifter reel drive motors 36, and pump motors 48,64 and provided that suitable memory capacity is available for storing a control program.

In the preferred embodiment of the present invention, the PLC 80 is programmed to initialize and reset the memory location associated with each measuring device 86 to a zero setting immediately upon receiving a signal from the associated immediately following fiber optic sensor 84 indicating passage of the black leader fabric section. Thus, as a new length of fabric is drawn upwardly from the scray 26 by the lifter reel assembly 28, the fiber optic sensor 84 in the poteye 82 of the lifter reel housing 32 recognizes the passage of the black leader fabric section and transmits a corresponding signal to the PLC 80, whose program in turn then begins counting from zero the number of signals received from the proximity sensor switch 92 of the associated measuring device 86 immediately preceding the lifter reel assembly 28 and also begins progressively calculating the yardage of the incoming fabric based upon the number of such signals received. In this manner, the PLC 80 is thereby enabled to continuously compute the yardage of the new length of fabric F being delivered into the first processing chamber 16A.

Likewise, as soon as the PLC 80 receives a similar signal from the fiber optic sensor 84 in the lifter reel assembly 52 above the exit end of the first chamber 16A signifying passage of the black leader fabric section, the PLC 80 similarly initializes to zero the counting of the number of signals received from the proximity sensor switch 92 of the immediately preceding measuring device 86 below such lifter reel assembly 52, whereby the PLC 80 is similarly enabled to continuously compute the yardage of fabric being delivered into the second processing chamber 16B. As the black fabric section at the leading end of the fabric F passes the fiber optic sensor 84 in each succeeding lifter reel assembly 52 at the end of each processing chamber 16B–16F in sequence, the PLC 80 initializes the internal counting and computation of fabric yardage based upon the signals received from each respectively associated proximity sensor switch 92 of each measuring device 86 immediately preceding each successive lifter reel assembly 52 and the measuring device 86 preceding the discharge lifter reel 74 at the exit end of the last chamber 16F.

In this manner, the PLC 80 continuously calculates independently seven different yardage values representing the yardage passing each of the seven measuring devices 86 located before and after each of the six processing chambers 16. As will be understood, therefore, by simple subtraction at any instantaneous moment over the course of a washing operation, the PLC can determine the actual yardage of fabric F present between any two successive measuring devices 86, which represents the yardage of the fabric F residing in the respective processing chamber 16A–16F therebetween.

The control program stored within the PLC 80 is set up to operate, after the black leader fabric has been detected to pass by the last fiber optic sensor 84 in the poteye 82 within the discharge housing 70 following the exit end of the last chamber 16F, to perform a comparison of the six independent yardage values computed for the six processing chambers 16A–16F, either continuously or at least periodically at relatively frequent intervals over the course of the washing operation performed on the fabric F so as to recognize promptly any imbalance in the yardage distribution of the fabric F among the six sequential chambers 16. From an operational standpoint, it is not considered necessary to attempt to obtain a nearly perfect yardage distribution over the entire course of washing operation. Hence, the control program stored in the PLC 80 includes a predetermined tolerance value representing a maximum acceptable amount of yardage variation from chamber to chamber. Such preprogrammed tolerance value may depend upon the size of the machine 10 and the total fabric yardage capacity thereof, upon the nature of the particular fabric F, and other possible variables. By way of example, but not limitation, it is believed that a yardage fluctuation tolerance of 20 yards from chamber to chamber will be sufficient for optimal operation of the machine 10 in washing most types of fabric.

According to the control program, when the yardage comparison performed by the PLC 80 reflects a difference in the resident yardage of the fabric in one chamber 16 in comparison to the other chambers 16 which exceeds the predetermined tolerance value, the PLC 80 initiates a corrective subroutine of the control program. In the preferred embodiment, if a given chamber 16A–16F accumulates a greater quantity of fabric than the other chambers 16, the PLC 80 is operative to briefly stop operation of the pump motor 48 or 64 and the drive motor 36 to the jet nozzle assembly 42 or 56 and the lifter reel assembly 28 or 52 which immediately precedes the chamber 16A–16F having the excessive amount of fabric, thereby to allow the excess of fabric to be depleted by the continuing operation of the lifter reel assemblies 52 and the jet nozzle assemblies 56 associated with the downstream chambers 16. Conversely, if the yardage of the fabric F in any one of the chambers 16A-16F falls below the resident fabric yardage in the other chambers by greater than the defined tolerance value, the corrective action initiated by the PLC 80 will be to deactuate one or more of the downstream lifter reel assemblies 52 and the associated jet nozzle assemblies 56 for a brief period of time sufficient to increase the yardage of the fabric F incoming to such chamber until its deficiency is overcome This manner of controlled stopping and starting of the jet nozzle assemblies 42,56 and the lifter reel assemblies 28,52 continues over the entire course of a washing operation so as to automatically correct imbalances in the amount of fabric F among the various chambers 16 and thereby maintain essentially the same amount of fabric in each chamber. Of courses, as persons skilled in the art will recognize, other embodiments of the apparatus can be contemplated wherein it may be desirable to maintain a differential amount of yardage of the fabric F among the plural chambers 16, depending upon various factors such as the nature of the fabric, any difference in the type of liquid treatment to which the fabric F is subjected from one chamber to the next, any engineered differential in the intended yardage capacity from one chamber to the next, etc. In such circumstances, the control program of the PLC 80 can be selectively designed to maintain a predetermined relationship between the yardage of fabric resident among the several chambers over the course of a wet processing operation.

The advantages of the present apparatus and method will thus be readily understood. By directly measuring the actual yardage of fabric entering each successive chamber in the present apparatus and then automatically correcting imbalances in the distribution of the fabric yardage among the multiple chambers of the apparatus, the present invention overcomes and eliminates all of the disadvantages of the prior art by ensuring precise accuracy in the distribution of fabric without risk of measurements being affected by variables such as the weight of the liquid content retained by the fabric, fabric slippage and tangling, etc. and without risk of potential damage to the fabric by physical contact with a switch or other mechanical measuring or sensing device. Further, the significant memory and program storage capacity of conventional programmable logic controllers enables substantial flexibility in controlling the operation of the apparatus, for example, by storing within the PLC memory multiple differing control programs any one of which may be actuated to carry out a desired mode of operation in a desired control methodology.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for wet processing an indeterminate length of traveling textile material, the apparatus comprising a plurality of material processing chambers, means for transporting the material sequentially through the chambers, means associated with each chamber for detecting the entrance of a leading end of the material into the respective chamber, means associated with each chamber for measuring the length of the material entering the respective chamber after the detecting means of the respective chamber detects the entrance of the leading end of the material, and data processing means associated with each detecting means and each measuring means for receiving data signals therefrom, for computing at least periodically the length of the material momentarily resident in each respective chamber and for comparing the respective computed lengths for the respective chambers with one another, and for adjustably controlling the transporting means to maintain predetermined relative lengths of the material within the respective chambers.

2. Apparatus for wet processing a textile material according to claim 1, wherein the data processing means comprises means for controlling the transporting means according to a predetermined program to maintain essentially the same relative lengths of the material within the respective chambers within a defined tolerance range.

3. Apparatus for wet processing a textile material according to claim 2, wherein the data processing means comprises a programmable logic controller.

4. Apparatus for wet processing a textile material according to claim 1, wherein each detecting means comprises means for optically recognizing the leading end of the textile material.

5. Apparatus for wet processing a textile material according to claim 4, wherein the material includes an optically detectible leader portion attached to the leading end.

6. Apparatus for wet processing a textile material according to claim 1, wherein each measuring means comprises a roller rotatably disposed in peripheral contact with the material to be rotated by traveling movement thereof and means for counting revolutions of the roller.

7. Apparatus for wet processing a textile material according to claim 1, wherein the data processing means comprises a programmable logic controller.

8. Apparatus for wet processing a textile material according to claim 1, wherein the chambers are configured for travel therethrough and wet processing therein of a textile fabric as the material.

9. Apparatus for wet processing a textile material according to claim 1, and further comprising means defining liquid overflow weirs between the chambers arranged at differing heights for flow of a processing liquid sequentially through the chambers opposite the direction of material travel through the chambers.

10. Apparatus for wet processing a textile material according to claim 1, wherein the transporting means comprises a driven material-conveying reel associated with each chamber and means associated with each chamber for impinging a jet of processing liquid on the material.

11. Apparatus for wet processing a textile material according to claim 10, wherein the data processing means is operatively connected with each reel and each liquid impinging means for selectively controlling operational adjustment thereof to adjust the relative lengths of material in the chambers.

12. Apparatus for wet processing a textile material according to claim 11, wherein the data processing means is programmed to stop operation of the reel and the liquid impinging means associated with any selected one of the chambers for decreasing the length of material therein and increasing the length of material in the preceding chamber.

13. A method of wet processing an indeterminate length of traveling textile material, the method comprising the steps of transporting the material sequentially through a plurality of material processing chambers, detecting the entrance of a leading end of the material into each respective chamber, measuring the length of the material entering each respective chamber after the entrance of the leading end of the material thereinto is detected, computing at least periodically the length of the material momentarily resident in each respective chamber, comparing the respective computed lengths for the respective chambers with one another, and adjustably controlling the transporting of the material to maintain predetermined relative lengths of the material within the respective chambers.

14. A method of wet processing a textile material according to claim 13, wherein the transporting of the material is controlled according to a predetermined program to maintain essentially the same relative lengths of the material within the respective chambers within a defined tolerance range.

15. A method of wet processing a textile material according to claim 13, wherein the detecting step comprises optically recognizing the leading end of the textile material.

16. A method of wet processing a textile material according to claim 13, wherein the measuring step comprises counting the revolutions of a roller rotatably disposed in peripheral contact with the material.

17. A method of wet processing a textile material according to claim 13 and further comprising causing a processing liquid to flow sequentially through the chambers opposite the direction of material travel through the chambers.

18. A method of wet processing a textile material according to claim 13, wherein the step of controlling the transporting of the material comprises stopping the travel of the material through any selected one of the chambers for decreasing the length of material therein and increasing the length of material in the preceding chamber.

* * * * *